United States Patent [19]

Crookshank

[11] 4,052,322

[45] Oct. 4, 1977

[54] CORROSION-INHIBITED GREASE COMPOSITIONS

[75] Inventor: Fred T. Crookshank, Port Arthur, Tex.

[73] Assignee: Texaco Inc., New York, N.Y.

[21] Appl. No.: 699,409

[22] Filed: June 24, 1976

[51] Int. Cl.[2] ..... C10M 3/18

[52] U.S. Cl. ..... 252/18; 252/40

[58] Field of Search ..... 252/18, 40

[56] References Cited

U.S. PATENT DOCUMENTS

| | | | |
|---|---|---|---|
| 3,182,020 | 5/1965 | Davis | 252/18 |
| 3,231,494 | 1/1966 | Morway | 252/18 |
| 3,259,577 | 7/1966 | Coant et al. | 252/18 |
| 3,736,256 | 5/1973 | Cross et al. | 252/18 |

FOREIGN PATENT DOCUMENTS

| | | |
|---|---|---|
| 202,620 | 9/1955 | Australia |

*Primary Examiner*—Arthur P. Demers

*Attorney, Agent, or Firm*—Thomas H. Whaley; Carl G. Ries; Henry W. Archer

[57] ABSTRACT

Described are lubricating greases corrosion inhibited by a synergistic amount of a mixture of sodium nitrite and N-acyl sarcosines.

The greases contain from 75 to 96 parts by weight, preferably 80 to 95 parts by weight of a mineral oil having a SUS viscosity of 50 to 2500 at 100° F thickened to grease consistency with about 3 to 25, preferably 5 to 20, parts by weight of an alkali metal or alkaline earth metal soap or a mixture thereof.

11 Claims, No Drawings

CORROSION-INHIBITED GREASE COMPOSITIONS

BACKGROUND OF THE INVENTION

Field of the Invention

This invention concerns nitrite-containing, corrosion-inhibiting greases and their preparation. More particularly, this invention concerns grease compositions incorporating combinations of inorganic nitrites with N-acyl sarcosines as their corrosion-inhibiting entity.

The use of corrosion-inhibiting compositions in oils and greases to minimize corrosion in moving parts such as bearings is well known in the lubricating art. In the absence of these compositions, metal parts, particularly those fabricated from the ferrous metals and their alloys, rapidly become oxidized in an environment of heat, moisture and free acidity. Once oxidized, these parts function unsatisfactorily, and prematurely require maintenance and/or replacement.

Corrosion inhibitors can be of different types or classes. Some are oil-soluble while others are oil-insoluble. Illustrative of the former type of inhibitors are the metal sulfonates and naphthenates, while the latter are exemplified by inorganic nitrite and borate salts. Generally, the oil-insoluble (water soluble) type of corrosion-inhibitors are preferred for static or quiescent operational conditions while the oil-soluble inhibitors have been favored in situations where the grease film is being constantly sheared and displaced (as in bearings). However, for applications where the greases are challenged by an environment of elevated temperatures and high humidity, neither the oil-soluble salts or the metal nitrates alone have been entirely satisfactory and novel and more effective combinations of inhibitors are sought. This is particularly the case in lithium soap-based greases and certain sodium soap-based greases where sodium nitrite alone in moderate amounts does not provide the desired degree of anti-corrosive protection. Increasing the quantity of nitrite is undesirable since in many instances it adversely affects the physical characteristics and stability of the grease. In view of this shortcoming much development work has been done to find materials which, when combined with the nitrites, will synergize or potentiate their corrosion inhibition.

DESCRIPTION OF THE PRIOR ART

The art to which this invention relates is aware, inter alia, of several U.S. Patents.

In U.S. Pat. No. 3,459,683, the use of an aromatic amine is disclosed to improve the anti-corrosive effect of alkali metal nitrites while in U. S. Pat. Nos. 3,098,848 and 2,971,911 certain heterocyclic amines are shown to potentiate sodium nitrite containing greases in their anti-corrosive properties. Unfortunately, other aromatic and heterocyclic amines have been shown to be ineffective. Similarly, certain aliphatic amines have been found to potentiate the effect of the nitrite component while others have little effect or an adverse effect on corrosion-inhibition. In U.S. Pat. No. 3,736,256 are disclosed alkali metal soap thickened greases containing 1 to 5 parts by weight of anti-corrosive composition containing from about 0.5 to 4.0 parts by weight of an inorganic nitrite such as calcium nitrite, barium nitrite, strontium nitrite, sodium nitrite, potassium nitrite, and mixtures thereof, and from about 0.5 to 1.0 parts by weight of at least one amine such as N-oleyltrimethylene diamine, aniline, bis-p-aminophenylethane, mixtures of tertiary aliphatic primary amines ranging from $C_{12}$–$C_{15}$ and having a molecular weight averaging 185–213, for each 10 parts by weight of alkaline earth metal soap-and/or alkali metal soap based grease.

None of the patents above mentioned suggest the synergistic combination of the present invention.

SUMMARY OF THE INVENTION

The invention resides in an additive package for lubricating greases, particularly high temperature greases, containing essentially of a mixture of sodium nitrite and an N-acyl sarcosine. The invention thus encompasses a grease of the character described containing from 0.01 to 7.5 weight percent of $NaNO_2$ and 0.05 to 7.5 percent of the sarcosine.

Suitable N-acyl sarcosines include lauroyl sarcosine, cocoyl sarcosine, oleoyl sarcosine, stearoyl sarcosine and other fatty sarcosines containing $C_8$ to $C_{22}$ carbon atoms and mixtures thereof with the weight ratio of sarcosine to nitrite ranging from 0.05 to 7.5 parts by weight of sarcosine to 0.075 to 7.5 parts by weight of nitrite.

The lubricating oils to be employed generally as the major component of the corrosion-inhibited high temperature greases include any of the hydrophobic oils of lubricating viscosity derived from synthetic or natural (petroleum) sources or their mixtures. The former include the aliphatic diesters such as bis-2-ethylhexyl sebacate, bis-dinonyl adipate, alkyl mixed pentaerythritol esters, alkyl silicates, polyoxyalkylene monomers and their copolymers, alkyl silicanes, alkyl and aryl phosphates such as trioctyl phosphate, tributyl phosphate, tricresyl phosphate, and the like.

The mineral or synthetic lubricating oils usually to be employed range upward in viscosity from about 50 SSU at 100° F. The viscosity index of the oil can vary from below 0 to about 100 or higher and any mineral oil may be highly refined and/or solvent treated.

The soaps conventionally utilized as the principal thickening or gelling agent for the greases comprise the alkali metal and/or alkaline earth metal soaps of saturated fatty acids ordinarily having between about 10 and 30 carbon atoms, branched chain or straight chain. The preferred acids have between about 12 and 24 carbon atoms per molecule. These are typified by myristic acid, a $C_{14}$ carbon chain length saturated fatty acid.

The compositions of the invention can contain also from 1 to 3 parts by weight of an oxidation inhibitor such as trimethyl hydroxy quinoline.

The sodium nitrite used in the subject compositions is described in detail in coassigned U.S. Pat. No. 3,736,256.

One test procedure used throughout this application to evaluate the corrosion inhibition properties of the inventive compositions is ASTM Designation: D 1743-64 entitled "Rust Preventive Properties of Lubricating Greases". In this procedure three clean new bearings are lubricated with the lubricant system to be evaluated, then run under a light thrust load for 60 seconds so as to distribute the lubricant in a pattern that might be found in service. The bearings are then subsequently stored for two weeks at 77° F and 100 percent relative humidity. After cleaning, the bearings are examined for evidence of corrosion and rated as follows according to the degree of corrosion found. A bearing showing no corrosion is rated 1. Incipient corrosion, no more than three spots of a size to be visible to the naked eye, is rated 2. Anything more severe is rated 3 and considered as a failure. If the ratings on two or three of the three bearings agree, this number is reported for the sample. If all three ratings are different, the test is repeated.

The Dropping Point Test (ASTM Designation D-566-64, "Dropping Point of Lubricating Grease") is a measure of the temperature at which the greases pass from a semi-solid to a liquid state under the condition of the test. In this test the subject grease is charged to a small grease cup of specified dimensions and heated at a specified rate. The temperature at which a drop of material falls from a small hole in the bottom of the cup is the dropping point.

The Penetration Test is a method for measuring the consistency of lubricating greases. The penetration is the depth, in tenths of a millimeter, that a standard cone penetrates the sample under prescribed conditions of weight, time and temperature. Three of the sample preparation procedures used are given in ASTM Designation D-217-68, "Cone Penetration of Lubricating Grease." These are the "Undisturbed Penetration," where the penetration of the grease is determined in its container as originally received with no disturbance; "Unworked Penetration," where the penetration is determined on the grease which has received only minimum disturbance in transfer from the original container to a grease worker cup or a dimensionally equivalent container; and "Worked Penetration," where the penetration of the grease is determined after it has been worked 60 double strokes in a grease worker. The 10,000 Stroke Fine Hole Worker Penetration is a variant of the test "Penetration of Lubricating Greases After Prolonged Working" as described in Method 313.2 of Federal Test Standard No. 791B. In this test the grease is worked 10,000 strokes in a grease worker equipped with a worker plate containing ⅛ inch holes rather than the ¼ inch hole prescribed in ASTM D-566-64. After this working the grease is cooled to 77° F and a worked penetration determined.

The Shell Roll Test (ASTM Designation D 1831-64, "Roll Stability of Lubricating Grease") is believed to be a measure of the shear stability of the grease. In this test a sample of the grease is subjected to the rolling action of a steel roller in a cylinder for 2 hours at room temperature. For this study the conditions were changed to 24 to 48 hours at 180° F. The change in penetration after 24 or 48 hours of rolling at 180° F. is a measure of the ability of the grease to maintain its consistency under shear at mildly elevated temperatures.

The Wheel Bearing Leakage Test (ASTM Designation D 1263-61) "Leakage Tendencies of Automotive Wheel Bearing Greases") measures the leakage tendencies of wheel bearing greases when tested under prescribed laboratory conditions. It provides a screening device that permits differentiation among products having distinctly different leakage characteristics. This test is run by charging the front wheel bearing and hub with the test grease, mounting them on the spindle and operating for six hours at 660 RPM and 220° F. Leakage of the grease or oil, or both, is measured and the conditions of the bearing surface noted at the end of the test.

The Water Washout Test (ASTM Designation D 1264-73, "Water Washout Characteristics of Lubricating Greases") measures the resistance of a lubricating grease to washout by water from a bearing when tested under prescribed laboratory conditions. The test is conducted by packing a ball bearing with the test grease, insering the bearing in a housing and rotating at 600 RPM. Water, controlled to the specified test temperature, impinges on the bearing housing at a rate of five milliliters a second. The amount of grease washed out in one hour is a measure of the resistance of the grease-water washout.

The invention is further illustrated by the following examples, some of which are presented in tabular form.

EXAMPLE 1–3

A sodium myristate thickened refined paraffinic oil product prepared from a mixture of paraffinic distillate and residual oils having a viscosity of 1350 SUS at 100° F was rust inhibited with sodium nitrite. The sodium nitrite used was a 30% slurry in oil. Concentrations of 1% and 2% by weight sodium nitrite (3.34 and 6.67% of the slurry) did not inhibit the grease against rusting, see batches 5194 and 5195, Table I, following. Upon increasing the sodium nitrite concentration to 3.00% (10% slurry), see batch 317 on Table I, satisfactory rust inhibition was realized. However, this additive dosage is higher than desired.

EXAMPLE 4–22

Various known rust inhibitors were evaluated as synergists or supplements to sodium nitrite and N-acyl sarcosines and found to be effective. For example, using as little as 0.5% cocoyl sarcosine with 0.45% sodium nitrite (1.5% slurry), see batches 5675 and 1214, borderline rust inhibition was achieved. Increasing the additive dosages of sodium nitrite and cocyl sarcosine to 1.00% and 0.35% or 1.5% and 0.1% resulted in excellent rust protection, see batches 3077 and 3747, 3078, 3748, 4789, and 3799, Table I. This good rust inhibition is realized at significantly lower concentrations than necessary when sodium nitrite is used alone.

The data of Table II show that the sarcosinenitrite system is unique since the imidazolines blends with sodium nitrite disclosed in U.S. Pat. No. 2,971,911, are not effective. Methylene dianiline blends with sodium nitrite disclosed in U.S. Pat. No. 3,459,683 also are not satisfactory.

TABLE I

INVESTIGATION OF RUST INHIBITING CHARACTERISTICS

| Example Number | Batch Number | Composition, % Weight | | | |
|---|---|---|---|---|---|
| | | Base Grease of Ex. 1–3 | 30% Sodium Nitrite Slurry ($NaNo_2$) | | Cocoyl Sarcosine |
| 1 | 5194 | 96.66 | 3.34 | (1.00) | — |
| 2 | 5195 | 93.33 | 6.67 | (2.00) | — |
| 3 | 317 | 90.0 | 10.0 | (3.0) | — |
| 4 | 320 | 89.5 | 10.0 | (3.0) | 0.5 |
| 5 | 319 | 92.0 | 7.5 | (2.25) | 0.5 |
| 6 | 3079 | 94.5 | 5.0 | (1.5) | 0.5 |
| 7 | 3078 | 94.9 | 5.0 | (1.5) | 0.1 |
| 8 | 3748 | 94.9 | 5.0 | (1.5) | 0.1 |
| 9 | 3789 | 94.9 | 5.0 | (1.5) | 0.1 |
| 10 | 3799 | 94.9 | 5.0 | (1.5) | 0.1 |
| 11 | 3077 | 96.3 | 3.35 | (1.00) | 0.35 |

TABLE I-continued

INVESTIGATION OF RUST INHIBITING CHARACTERISTICS

| | | | | | |
|---|---|---|---|---|---|
| 12 | 3747 | 96.3 | 3.35 | (1.00) | 0.35 |
| 13 | 5675 | 98.0 | 1.5 | (0.5) | 0.5 |
| 14 | 1214 | 98.0 | 1.5 | (0.5) | 0.5 |
| 15 | 5671 | 99.5 | — | | 0.5 |
| 16 | 322 | 97.0 | 0.5 | (0.15) | 2.5 |
| 17 | 321 | 94.5 | 0.5 | (0.15) | 5.0 |
| 18 | 323 | 89.5 | 0.5 | (0.15) | 10.0 |
| 19 | 324 | 100 | — | | — |
| 20 | 2462 | 100 | — | | — |
| 21 | 5670 | 100 | — | | — |
| 22 | 168 | 100 | — | | — |

Test Results

| Example No. | Rust Prevent. Properties | Dropping Point, ° F | Penetrations Undisturbed | Penetrations Unworked | Penetrations Worked | Penetrations 10,000 Strokes Fine Hole | Shell Roll Test 24 Hrs at 180° F Penetration Change Points | Shell Roll Test 24 Hrs at 180° F Penetration Change Percent |
|---|---|---|---|---|---|---|---|---|
| 1 | Fail | 398 | — | 246 | 307 | — | — | — |
| 2 | Fail | 397 | — | 230 | 300 | — | — | — |
| 3 | Pass | 426 | 166 | 212 | 265 | 314 | +34 | 13 |
| 4 | Pass | 386 | 180 | 214 | 291 | 360 | +85 | 28 |
| 5 | Pass | 438 | 177 | 219 | 264 | 349 | — | — |
| 6 | Pass | 383 | — | — | 290 | — | — | — |
| 7 | Pass | — | — | — | 291 | — | — | — |
| 8 | Pass | 418 | — | 248 | 268 | — | 41* | 15* |
| 9 | Pass ck Pass | 406 | — | 240 | 267 | — | — | — |
| 10 | Pass ck Pass | 389 | — | 255 | 277 | — | — | — |
| 11 | Pass | 401 | — | — | 292 | — | — | — |
| 12 | Pass | 389 | — | 234 | 266 | — | +67* | 23* |
| 13 | Fail ck Pass | — | 217 | 238 | 282 | — | 49 | 17.3 |
| 14 | Pass | — | 243 | 269 | 297 | — | 35 | 11.5 |
| 15 | Fail | — | 232 | 242 | 278 | — | — | — |
| 16 | Pass | 330 | 212 | 231 | 306 | 365 | −26 | 8.5 |
| 17 | Pass | 230 | 96 | 160 | 268 | 390 | +22 | 7.6 |
| 18 | Too Fluid to Test | | | | | | | |
| 19 | Pass ck Fail | 383 | 225 | 243 | 280 | 353 | +20 | 7.1 |
| 20 | Fail | 417 | — | 263 | 293 | — | — | — |
| 21 | Fail | — | 241 | 260 | 294 | — | — | — |
| 22 | Fail | 397 | — | — | 275 | — | +25* | 8.7* |

*48 Hrs at 180° F.

TABLE II

INVESTIGATON OF RUST INHIBITING CHARACTERISTICS

| Example No. | Batch Number | Base Grease of Ex 1-3 | Composition % Wt. 30% Sodium Nitrite Slurry ($NaNO_2$) | Additive |
|---|---|---|---|---|
| 23 | 1241 | 96.34 | 3.33 (1.00) | 0.33% 2-Heptadecenyl-1-(2-Hydroxyethyl)-2-Imidazoline |
| 24 | 1272 | 96.34 | 3.33 (1.00) | 0.33% 2-Heptadecenyl-1-(2-Hydroxyethyl)-2-Imidazoline |
| 25 | 1242 | 96.34 | 3.33 (1.00) | 0.33% 1-Hydroxyethyl-2-Heptadel-8-ene-imidazoline |
| 26 | 1274 | 96.34 | 3.33 (1.00) | 0.33% 1-Hydroxyethyl-2-Heptadel-8-ene-imidazoline |
| 27 | 1240 | 96.34 | 3.33 (1.00) | 0.33% Methylene Dianiline |

Test Results

| Example No. | Rust Prevent. Properties | Dropping Point, ° F | Penetrations Undisturbed | Penetrations Unworked | Penetrations Worked | Shell Roll Test 24 Hrs at 180° F Penetration Change Points | Shell Roll Test 24 Hrs at 180° F Penetration Change Percent |
|---|---|---|---|---|---|---|---|
| 23 | Fail | — | 205 | 270 | 287 | 135 | 49.7 |
| 24 | Fail | — | 207 | 252 | 302 | — | — |
| 25 | Pass | — | 205 | 266 | 288 | 55 | 20.0 |
| 26 | Indeterminate | — | 214 | 249 | 297 | 83 | 29.4 |
| 27 | Pass ck Fail | — | 203 | 264 | 281 | 70 | 20.8 |

TABLE III

EFFECT ON ADDITIVES ON GREASE PROPERTIES

| Batch No. | 3747-RL-70 | 3748-RL-70 | 168-GL-70 |
|---|---|---|---|
| Composition, % wt. | | | |
| Base Grease of Ex. 1-3 | 96.30 | 94.90 | 100.00 |
| 30% $NaNO_2$ Slurry | 3.35 | 5.00 | — |
| Cocoyl | 0.35 0.10 | — | |
| Performance Test Results | | | |
| Shell Roll Test, 48 Hrs. at 180° F | | | |
| Initial Penetration | 285 | 276 | 286 |
| Final Penetration | 352 | 317 | 311 |
| Penetration Change Points | +67 | +41 | −25 |
| Wheel Bearing Leakage Loss Grams | 0.3 | None | None |
| Mod. Water Washout Test Washout % | 36.0 | 28.0 | 29.5 |

The data given on Table III, above, show that the additive package of nitrite/sarcosine does not degrade the grease properties.

It will be appreciated by those skilled in the art that various methods exist for blending the various components of the disclosed formulations. The preferred method of incorporating the inorganic nitrite into the grease is to prepare a dispersion thereof in a mineral oil base using a dispersant such as a polyalkylene polymer or a sulfonate. The resulting dispersion is then added to the preformed grease or to its component parts with suitable heating and stirring. The various blending techniques used are described in greater detail in coassigned U.S. Pat. No. 3,736,256 and incorporated by reference herein.

While the invention has been illustrated by reference to the combination of sodium nitrite and cocoyl sarcosine, it should be noted that other compounds possess substantially the same properties. Thus alkali metal nitrites and alkaline earth metal nitrites including barium nitrite, strontium nitrite, potassium nitrite, lithium nitrite and mixtures thereof can be used instead of sodium nitrite. Similarly, the N-acyl sarcosines can be any other fatty acid sarcosine having from 8 to 22 carbon atoms per molecule including lauroyl sarcosine, oleoyl sarcosine, stearoyl sarcosines and mixtures thereof.

As the foregoing specification including the several examples indicate, the invention is advantageous in several respects. For example, the present compositions containing inorganic nitrites and N-acyl sarcosines are compatible with various mineral and synthetic oils and additives employed in grease formulations. In addition, inasmuch as the components are low in cost and function well at low concentration levels, the present compositions afford long term protection against corrosion at relatively low cost.

It is noteworthy to remark that the results obtained with the claimed compositions are surprising and unexpected in that the corrosion inhibiting effect obtained in using the disclosed N-acyl sarcosines with inorganic nitrites is substantially greater than the protection obtained in utilizing these components singly. Similarly, since the N-acyl sarcosines provide this synergistic corrosion inhibition in this severe application while other previously known synergistic materials do not provide this gain in activity, the inventive composition provides unexpected and unobvious results.

What is claimed is:

1. A lubricating grease having superior anti-corrosive properties comprising a homogeneous admixture of the following components in their indicated range of proportions:

a. from about 75 to 96 parts by weight of oil of lubricating viscosity thickened to grease consistency with about 2 to 25 parts by weight of a soap selected from the group consisting of alkali metal soaps, alkaline earth metal soaps and mixtures thereof, and b. from about 1.0 to 10.0 parts by weight of a corrosion-inhibiting composition comprising:

1. at least one inorganic nitrite, 2. at least one N-acyl sarcosine selected from the group consisting of lauroyl sarcosine, cocoyl sarcosine, oleoyl sarcosine, stearoyl sarcosine, fatty acid sarcosines containing from 8 to 22 carbon atoms per molecule and mixtures thereof, the weight ratio of sarcosine to nitrite varying from about 0.05 to 7.5 parts by weight of sarcosine to 0.075 to 7.5 parts of weight of nitrite.

2. The grease of claim 1 wherein the inorganic nitrite is an alkali metal nitrite.

3. The grease of claim 2 wherein the grease contains an emulsifiable polyalkylene polymer as an additive.

4. The grease of claim 2 wherein the nitrite is an alkali metal nitrite and the soap is an alkali metal soap.

5. A lubricating sodium soap-based grease comprising a homogeneous admixture of the following components in the indicated proportions:

a. from about 80 to 95 parts by weight of a mineral oil having a SUS viscosity of 50 to 2500 at 100° F, thickened to grease consistency with about 5 to 20 parts by weight of a sodium soap, and b. from about 1 to 20 parts by weight of a corrosion-inhibiting composition comprising 1. from about 0.01 to 7.5 parts by weight of sodium nitrite, and 2. from about 0.05 to 7.5 parts by weight of cocoyl sarcosine; and c. about 3 parts by weight of an oxidation inhibitor.

6. The admixture of claim 5, wherein the sodium soap is the sodium salt of myristic acid.

7. The admixture of claim 5, wherein the sodium soap is the sodium salt of a tallow fatty acid.

8. The admixture of claim 5, wherein the mineral oil is a mixture of paraffinic distillate, and/or residual paraffinic oils.

9. The admixture of claim 5, wherein the mineral oil has a viscosity of about 1350 SUS at 100° F.

10. A synergistic corrosion-inhibitor composition which can be incorporated into greases in the proportion of from about 1.0 to 10.0 parts by weight of said inhibitor composition for each 100 parts by weight of finished grease comprising:

a. from about 0.01 to 9.5 parts by weight of an inorganic nitrite selected from the group consisting of alkali metal nitrites, alkaline earth metal nitrites and mixtures thereof, and b. from about 0.05 to 9.5 parts by weight of an N-acyl sarcosine selected from the group consisting of lauroyl sarcosine, cocoyl sarcosine, oleoyl sarcosine, stearoyl sarcosine, fatty acid sarcosines containing from 8 to 22 carbon atoms per molecule and mixtures thereof, the weight ratio of sarcosine to nitrite varying from about 0.05 to 7.5 parts by weight of sarcosine to 0.075 to 7.5 parts by weight of nitrite.

11. The composition of claim 10, wherein said inorganic nitrite is sodium nitrite and said N-acyl sarcosine is cocoyl sarcosine.

* * * * *